US007272914B2

(12) United States Patent
Hage-Chahine et al.

(10) Patent No.: US 7,272,914 B2
(45) Date of Patent: Sep. 25, 2007

(54) STEEL JOIST

(75) Inventors: Georges Hage-Chahine, Ville Mont-Royal (CA); Pierre Gignac, St-Lambert (CA)

(73) Assignee: Groupe Canam Inc, Boucherville, Quebec (CA)

( * ) Notice: Subject to any disclaimer, the term of this patent is extended or adjusted under 35 U.S.C. 154(b) by 115 days.

(21) Appl. No.: 10/977,575

(22) Filed: Oct. 29, 2004

(65) Prior Publication Data

US 2005/0120668 A1 Jun. 9, 2005

(30) Foreign Application Priority Data

Oct. 30, 2003 (CA) ..... 2447374

(51) Int. Cl.
*E04B 5/18* (2006.01)

(52) U.S. Cl. ..... 52/334; 52/335; 52/338; 52/340; 52/321; 52/726.1; 52/729.2

(58) Field of Classification Search ..... 52/330, 52/338, 454, 335, 329, 726.1, 729.2, 730.1, 52/730.2, 424, 433, 340, 321, 319, 320, 734
See application file for complete search history.

(56) References Cited

U.S. PATENT DOCUMENTS 1,968,045 A * 7/1934 Kotrbaty ..... 52/220.2
1,993,791 A * 3/1935 Kotrbaty ..... 52/383
2,169,253 A * 8/1939 Kotrbaty ..... 52/693
2,860,743 A * 11/1958 Cliff ..... 52/692
3,362,121 A * 1/1968 Weber ..... 52/334
4,015,396 A * 4/1977 Butts et al. ..... 52/690
4,454,695 A 6/1984 Person
4,592,184 A 6/1986 Person et al.
4,700,519 A 10/1987 Person et al.
4,729,201 A 3/1988 Laurus et al.
5,544,464 A * 8/1996 Dutil ..... 52/330
6,061,992 A 5/2000 Vincent
6,959,520 B2 * 11/2005 Hartman ..... 52/729.2
2003/0024205 A1 2/2003 Strickland
2003/0084629 A1 5/2003 Strickland et al.

FOREIGN PATENT DOCUMENTS

CA 2404535 3/2004

* cited by examiner

*Primary Examiner*—Jeanette Chapman
(74) *Attorney, Agent, or Firm*—Merchant & Gould P.C.

(57) ABSTRACT

A joist suitable for use in a composite concrete floor is disclosed. The joist comprises a top chord, a bottom chord; and a vertically extending intermediate web having a top end secured to the top chord and a bottom end secured to the bottom chord. The top chord comprises a pair of longitudinally continuous symmetrical chord members facing each other and embracing the top end of the web. Each of the chord members includes a vertical portion secured to the top end of the web and a slanting upper extension extending above and away from the top end of the web, thereby providing a shear connecting portion and a flared opening, between the two facing chord members, giving access to the web and improving access of a welding tool to the area between the symmetrical portion of the top chord and the web member that must be joined together.

6 Claims, 4 Drawing Sheets

STEEL JOIST

FIELD OF THE INVENTION

The present invention generally relates to an improved steel joist. More particularly, it relates to a steel joist having a flared top chord which can be used as part of a composite floor system for use in the construction of buildings.

BACKGROUND OF THE INVENTION

Floor construction in building projects can involve the use of steel joists placed in different positions spanning structural supports and a concrete slab subsequently poured on decking supported by the joists. The slab and the joist form a composite structure having superior strength properties compared to a conventional non-composite floor system. Generally, the joist is in the form of a truss having top and bottom chords that are connected by a web. The web itself can vary in design by either being constructed of solid material or comprising tension and compression members triangulating the space between the top and bottom chords.

U.S. Pat. No. 4,729,201 granted to Laurus et al. discloses a joist consisting of a web, a bottom chord and a double top chord construction consisting of two elongated substantially identical portions each being of S cross-section, extending the length of the joist. This design of the top chord improves the lateral stiffness which improves the strength of the composite structure during construction stages and permits safer construction procedures particularly where long spans are involved. The symmetry of the top chord provides structural advantages during the installation stage where the unpropped joist is required to carry the weight of wet concrete, form work, its own weight and other construction live loads. The serpentine top chord profile provides a cross-sectional area whereby the resulting lateral slenderness properties of the joist are improved and the joist is consequently stiffened. The increased stiffness improves the resistance of the joist to compressive stresses.

Several other prior art documents describe various types of joist designs for use in composite floor systems. These documents are known to the Applicant by the following patent numbers: U.S. Pat. No. 5,544,464 (Dutil), U.S. Pat. No. 6,061,992 (Vincent), US 2003/0024205 A1 (Strickland), CA U.S. Pat. No. 2,404,535 (Moreau), US 2003/0084629 (Strickland et al.), U.S. Pat. No. 4,454,695 (Person), U.S. Pat. No. 4,700,519 (Person et al.) and U.S. Pat. No. 4,592,184 (Person et al.).

A symmetrical shape of the joist also helps avoid such problems as sweep. Sweep is a phenomenon that is encountered during construction of a welded joint between the chord and the web of the joist, where all welds are made on one side of the web. This welding can create a stress in the joint which tends to result in a certain amount of curvature in the completed joist. This curvature effect can usually be avoided. This was previously accomplished by pre-curving of the top chord in a direction opposite of that of the sweep effect. The pre-curving of the top chord results in a substantially straight longitudinal configuration for the completed joist once welded together. A symmetrical top chord avoids this entire problem of sweep as a straight joint is obtained without the necessity for complicated pre-assembly compensation techniques. Symmetry in the top chord also doubles the amount of shear bond between the joist and the concrete slab.

However, during the fabrication process for steel joists, access to the area to be welded between the chord and the web element is difficult due to the overall shape of the serpentine top chords that are currently used in different joist designs. The shape of the top chord in these designs prevents a welding tool from being inserted between the two leg elements of the chord from a point directly above the joist. This problem complicates the joist welding process during manufacturing of joists in an assembly line.

Thus, there is still presently a need for a top chord design that would facilitate this welding process during fabrication of joists without losing the advantages of symmetrical top chords.

SUMMARY OF THE INVENTION

An object of the present invention is to propose a steel joist that satisfies the above-mentioned need.

Another object is to propose a steel joist design that facilitates the fabrication process of steel joists by improving access of the welding tool to the area between the symmetrical portion of the top chord and the web member that must be joined together.

According to the present invention, that object is achieved with a flared top chord symmetrical shape design.

More particularly, the present invention provides a joist suitable for use in a composite concrete floor. The joist comprises a top chord, a bottom chord and a vertically extending intermediate web having a top end secured to the top chord and a bottom end secured to the bottom chord. The top chord is characterized in that it comprises a pair of longitudinally continuous symmetrical chord members facing each other and embracing the top end of the web. Each of the chord members includes a vertical portion secured to the top end of the web and a slanting upper extension extending above and away from the top end of the web, thereby providing a shear connecting portion and a flared opening between the two facing chord members giving access to the web.

This flared opening facilitates insertion of a welding tool. The resulting opening is made sufficiently large such that a welding tool can be easily inserted between the chord members to create a welded joint between the vertical portion of the top chord members and the web elements of the joist.

In accordance with a preferred aspect of the invention, the upper extension of each chord member comprises a top end formed as a lip.

The slanting extensions which are provided with the lip provide shear connecting portions once it is embedded in the concrete slab.

In accordance with a further preferred aspect, each of the chord members comprises a groove between the vertical portion and the upper extension to provide an additional ribbed member for compression portion and to retain a closure element to hold the concrete in place during pouring of the composite concrete floor.

Preferably, such grooves, that can also be referred to as dimples, benefit from an increased cross-sectional area of the leg, whereby the resulting lateral slenderness properties of the joist are improved and the joist is consequently stiffened, as is the case with joists using serpentine-shaped top chords. These dimples can be added at specific locations, such as the midpoint of the leg, to act as an alignment guide during fabrication of the composite floor or to hold pour-stop closure elements in place during pouring of the concrete slabs.

The two chord members, which can also be referred to as legs of the top chord, extend outwardly in a symmetrical manner and continue to benefit from the advantages cited above for symmetrical top chords in prior art. These advantages include an elimination or reduction of weld distortion and a full utilization of both legs to create a shear bond between the joist and the concrete slab.

In accordance with another preferred aspect, each of the symmetrical chord members includes a horizontal shelf which allows the placement of a steel deck. This steel deck can be welded, nailed or screwed to the joist. Preferably, the horizontal shelf comprises an outer end formed as a lip A non-restrictive description of a preferred embodiment of the invention will now be given with reference to the appended drawings.

DESCRIPTION OF PREFERRED EMBODIMENTS

Figure 1:
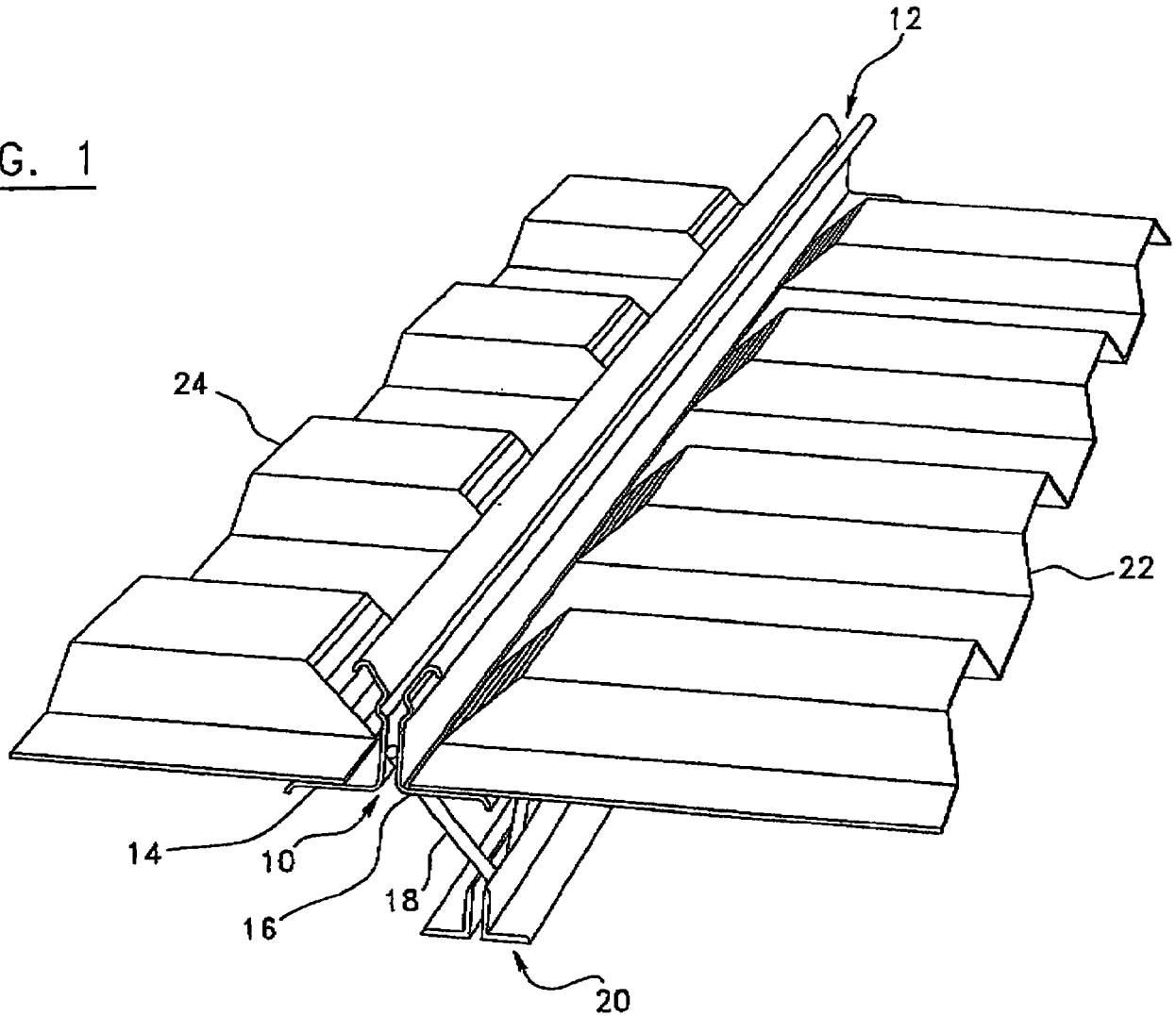
FIG. 1 is a perspective view of a joist according to a preferred embodiment of the invention, with corrugated decking placed on the horizontal shelves of the top chord.
Figure 2:
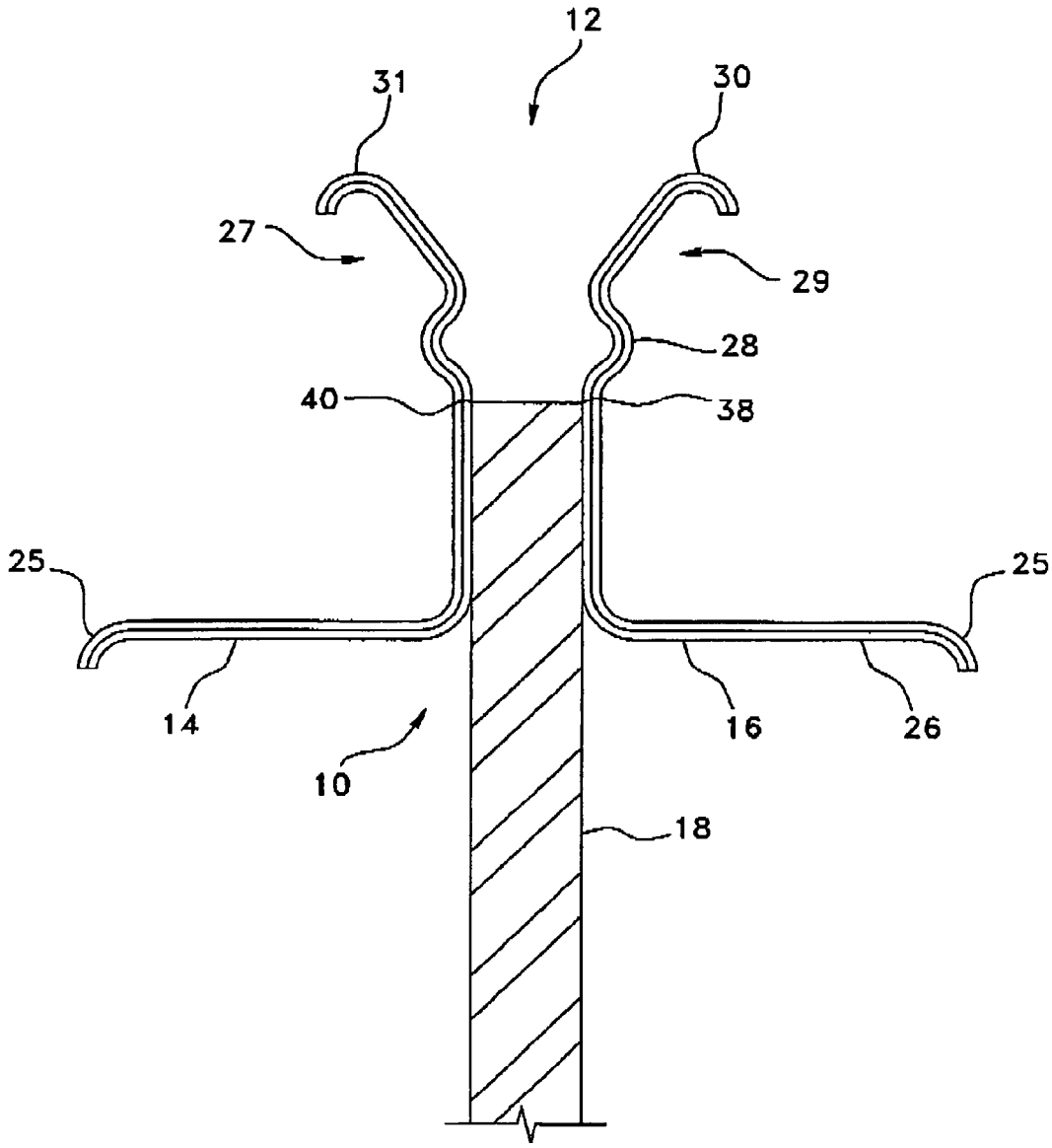
FIG. 2 is a cross-section view of a top portion of a joist according to the invention showing more specifically the top chord.
Figure 3:
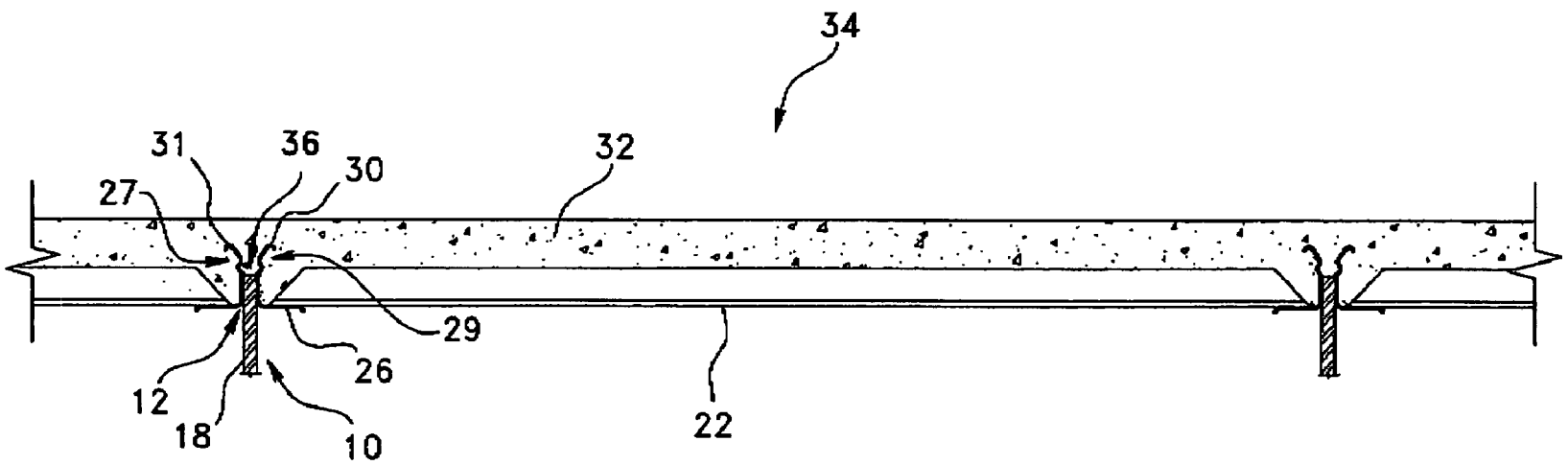
FIG. 3 is a partial cross-section view through a composite floor showing the upper portion of two adjacent joists supporting a deck on both sides, and a concrete slab poured onto the joists and deck to form the composite floor.

Referring to any one of FIGS. 1 to 3, a steel joist (10) according to a first preferred embodiment of the invention comprises a top chord (12), a bottom chord (20) and a vertically extending intermediate web (18) having a top end secured to the top chord (12) and a bottom end secured to the bottom chord (20). The top chord (12) is characterized in that it comprises a pair of longitudinally continuous symmetrical chord members (14 and 16) facing each other and embracing the top end of the web (18). Each of the chord members (14 and 16) includes a vertical portion secured to the top end of the web (18) and a slanting upper extension (27 and 29) extending above and away from the top end of the web (18), thereby providing a shear connecting portion and a flared opening between the two facing chord members (14 and 16) giving access to the web (18).

More particularly, the joist according to the present invention comprises a top chord (12) including two symmetrical chord members, hereinafter referred to as leg members (14 and 16), which are attached to the web (18). The joist (10) further comprises a bottom chord (20) attached to the bottom part of the web (18) and completes the I-beam-like design of the joist (10), the top chord (12) and bottom chord (20) playing the role of top and bottom flanges respectively for the beam. The top two leg members (14 and 16) support the corrugated deck (22 and 24) elements.

Figure 4:
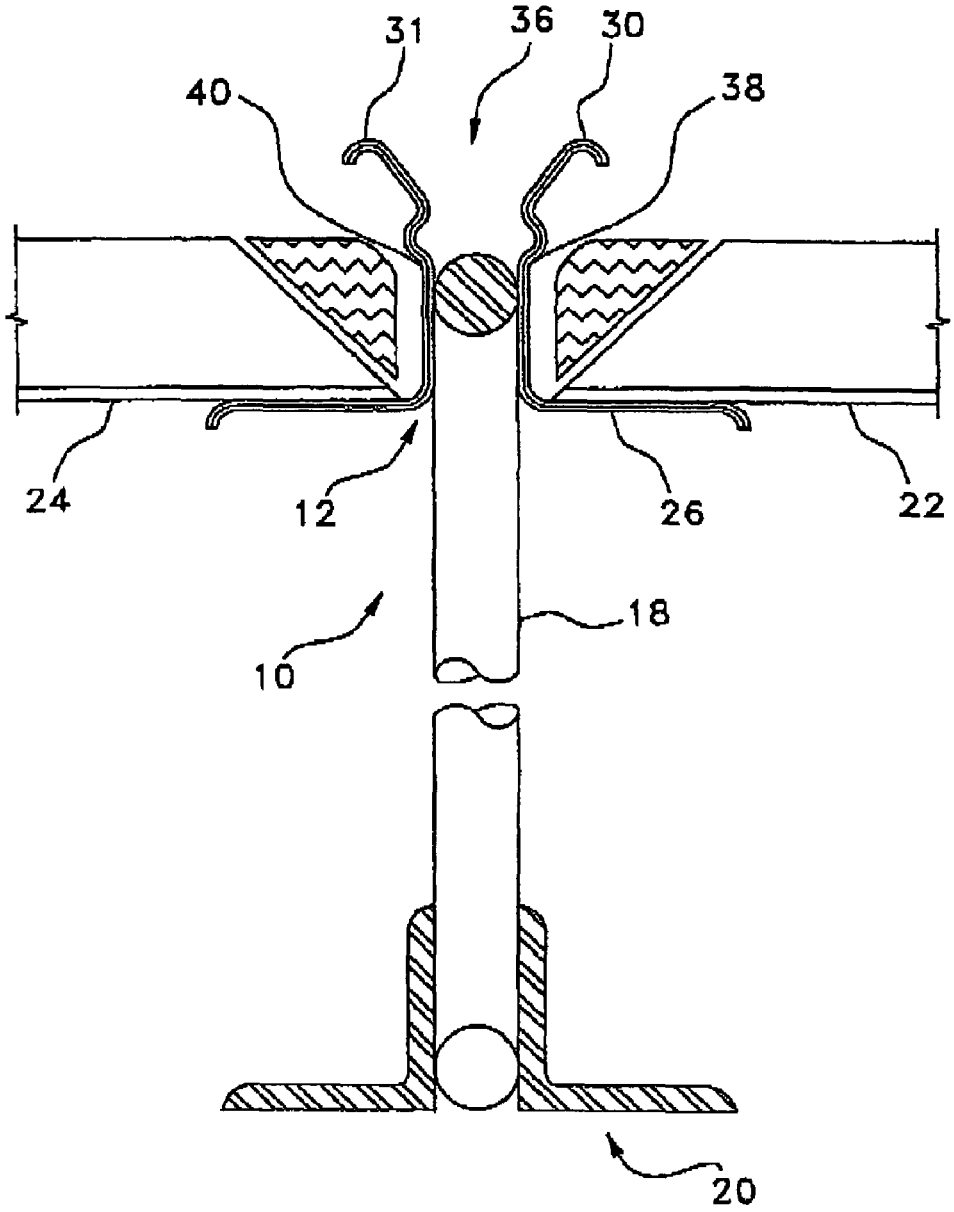
FIG. 4 is a cross section view of the joist shown in FIG. 1.

Referring to FIGS. 2 and 4, a top chord leg (16) preferably comprises a horizontal shelf (26) which supports the deck (22). The horizontal shelf (26) comprises a lip (25) which stiffens the horizontal shelf (26) to provide a better distribution of the load brought in by the deck (22) and to better resist stress concentration points created by the nailing, welding or screwing of the deck (22) to the horizontal shelf (26). It is however worth mentioning that, instead of being provided with such a shelf, the top chord leg could advantageously be provided with a substantially downward vertical extension provided with openings, as in the joist described in U.S. Pat. No. 4,729,201, for receiving bars which serve to support form work, and that without departing from the scope of the present invention. The top chord leg (16) further comprises an upper slanting extension (29) provided with a lip (30) that eventually becomes embedded in a concrete slab in the completed composite floor system as will be described below. The top chord leg (16) can also comprise a dimple (28) that can be added at specific locations of the leg, such as its midpoint, to act as an alignment guide during fabrication of the composite floor or to hold pour-stop closure elements in place during pouring of the concrete slabs.

FIG. 3 shows the interrelationship between the joist (10), the deck elements (22 and 24) and the concrete slab (32) once the concrete slab (32) is poured on the deck elements (22 and 24) and the joist (10). After pouring of the concrete slab (32) on the deck elements (22 and 24), the upper extensions (27 and 29) with the lips (30 and 31) of the top chord (12) become embedded in the concrete slab (32) and form a composite floor structure (34) having superior strength properties compared to a conventional non-composite floor system as a shear connection is created between the joist (10) and the concrete slab (32).

As can be appreciated, the flared design of the upper extensions (27 and 29) creates an opening (36) in the top chord (12) which is sufficiently large to permit insertion of a welding tool between the two legs (14 and 16). This new configuration of the upper extensions (27 and 29) allows an access of the welding electrode through the top of the joist (10) to make satisfactory welds at the welding points (38 and 40) between the top chord (12) and the web member (18), which greatly simplifies manufacturing of the joist (10).

Preferably, each of the chord members of the top chord is made of a formed metal sheet.

Although the present invention has been explained hereinabove by way of preferred embodiments thereof, it should be understood that the invention is not limited to these precise embodiments and that various changes and modifications may be effected therein without departing from the scope or spirit of the invention.

What is claimed is:

1. A joist suitable for use in a composite concrete floor, comprising:

a top chord;

a bottom chord; and a vertically extending intermediate web having a top end secured to the top chord and a bottom end secured to the bottom chord, the top chord comprising:

a pair of longitudinally continuous symmetrical chord members facing each other and embracing the top end of the web, each of said chord members including:

a lower vertical portion secured to said top end of the web;

a top chord lip bending downward; and a slanting linear upper extension continuous to and between the lower vertical portion and the top chord lip, said linear upper extension extending above and away from the top end of the web, thereby providing a shear connecting portion and a flared substantially V-shaped opening between the two facing chord members giving access to the web.

2. A joist as claimed in claim 1, wherein each of said chord members of the top chord comprises at a lower end thereof a horizontal shelf extending away from said vertical portion to support a decking.

3. A joist as claimed in claim 2, wherein the horizontal shelf of each of said chord members of the top chord comprises an outer end formed as a lip.

4. A joist as claimed in claim 1, wherein each of said chord members of the top chord comprises a groove between the vertical portion and the linear upper extension to provide an additional shear connection portion and to hold a concrete closure element in place during fabrication of a composite concrete floor.

5. A joist as claimed in claim 1, wherein each of said chord members of the top chord is made of a formed metal sheet.

6. A joist as claimed in claim 1, wherein each of said chord members of the top chord comprises at a lower end thereof a substantially downward vertical extension provided with openings to receive spanner bars to support concrete form work.

* * * * *